United States Patent [19]

Fowler

[11] 4,136,617

[45] Jan. 30, 1979

[54] ELECTRONIC DELAY DETONATOR

[75] Inventor: Steven E. Fowler, Ridgecrest, Calif.

[73] Assignee: The United States of America as represented by the Secretary of the Navy, Washington, D.C.

[21] Appl. No.: 816,415

[22] Filed: Jul. 18, 1977

[51] Int. Cl.[2] ..... F42C 11/06

[52] U.S. Cl. ..... 102/220; 102/206

[58] Field of Search ..... 102/70.2 R, 206, 218, 102/219, 220

[56] References Cited

U.S. PATENT DOCUMENTS

| | | | |
|---|---|---|---|
| 3,741,124 | 6/1973 | Visk | 102/70.2 R |
| 3,851,589 | 12/1974 | Meyer | 102/70.2 R |
| 3,853,063 | 12/1974 | Hoyt | 102/70.2 R |
| 3,862,602 | 1/1975 | Manning | 102/70.2 R |
| 3,885,501 | 5/1975 | Schneider | 102/70.2 R |
| 3,888,181 | 6/1975 | Kups | 102/70.2 R |
| 3,924,535 | 12/1975 | Roos et al. | 102/70.2 R |
| 3,952,661 | 4/1976 | Vrataric, Jr. et al. | 102/70.2 R |
| 3,967,554 | 7/1976 | Troyer, Jr. | 102/70.2 R |
| 3,986,457 | 10/1976 | Mountjoy | 102/70.2 R |
| 4,013,012 | 3/1977 | Giattino | 102/70.2 R |

*Primary Examiner*—Charles T. Jordan

*Attorney, Agent, or Firm*—R. S. Sciascia; W. Thom Skeer; Kenneth G. Pritchard

[57] ABSTRACT

An electric detonator is fired by energy stored in the circuit upon arming of the system. A bridgewire grounds the trigger signal until sufficient input is present to blow out the bridgewire. The trigger signal then passes through a time delay circuit which gates a silicon controlled rectifier. This permits a closed circuit loop between the detonator and the stored energy.

12 Claims, 7 Drawing Figures

ENERGY REQUIRED TO ARM: 15V AT 18mA FOR 53ms = 143,100 ERGS

ENERGY REQUIRED TO FIRE: 7,500 ERGS

TOTAL ENERGY REQUIRED: 150,600 ERGS

ELECTRONIC DELAY DETONATOR

BACKGROUND OF THE INVENTION

1. Field of the Invention

This invention pertains to detonation devices. In particular it pertains to electronic detonators and in even greater specificity to electronic delay detonators.

2. Description of the Prior Art

Present delay detonator systems are composed of two types, pyrotechnic and electrical, as shown in FIG. 1-A and FIG. 1-B.

The pyrotechnic delay detonators have the following limitations:

1. Present pyrotechnic delays have an error factor of about 10%, which can increase to almost 20% when exposed to temperature, shock, and vibration.

2. The time delays of pyrotechnic systems cannot be changed without redesigning the device.

3. One hundred percent acceptance testing cannot be done on pyrotechnic delays because they are destroyed when used.

The present electrical delay systems although satisfactory in some applications have limitations. For example, the electrical delay output tends to be unreliable, because the detonator is initiated through the arming switch, and the reliability of the arming switch is poor after target impact. The electrical delay systems are made up of discrete parts, which are usually part of the safety and arming device, thus making it difficult to interchange the electrical delays of different weapons. A further problem with prior art constructions is that such electrical delays were more expensive than the more reliable pyrotechnic delay detonator systems.

SUMMARY OF THE INVENTION

The present invention changes the electrical delay circuit so that the trigger pulse is past the arming switch before impact can break the switch contact. To accomplish this a firing and power storage circuit has been designed.

To protect against accidental firings that might occur from such a combined circuit set-up, four safeguards are included in the over-all circuitry. These are the normal safety circuit, a current regulator to prevent excessive energy entering the storage circuit and overloading it enough to fire the detonator, a power-up reset circuit to ensure the time delay circuit is set to zero when the system is armed, and a bridgewire acting as a fuse to ground the trigger input signal until a sufficient triggering signal is inputted to short out the bridgewire.

Accordingly, objects of this invention are to provide an electronic delay circuit that has high reliability after impact, that is impossible to trigger below a minimum level triggering voltage, that has low susceptibility to temperature, shock and vibration, that has provision for changing of the time delay with relative ease, and which permits one hundred percent acceptance testing.

DESCRIPTION OF THE PREFERRED EMBODIMENT

Figure 1A:
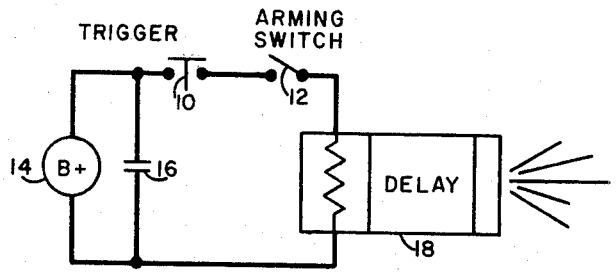
FIG. 1A (PRIOR ART)
FIG. 1-A and FIG. 1-B are circuit diagrams of Prior Art delay detonator systems.
Figure 1B:
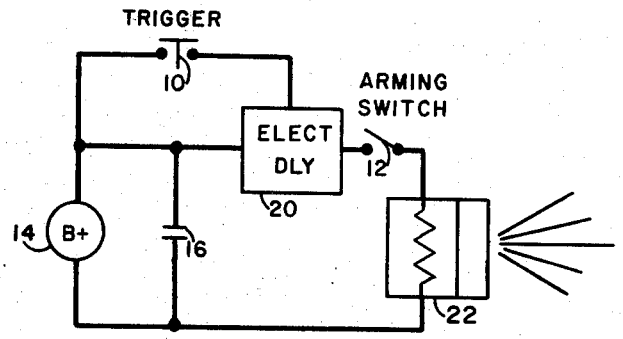
FIG. 1B (PRIOR ART)

FIG. 1 is a circuit diagram of the present delay systems used. FIG. 1-A, shows the present pyrotechnic delay detonator system which includes trigger 10, arming switch 12, battery 14, capacitor 16, and delay detonator 18. The pyrotechnic detonator functions by having the arming switch closed to arm explosives followed by the appropriate trigger switch 10 being closed. Upon closing of trigger 10, capacitor 16, which has been charged by battery 14, is free to discharge through detonator 18, which includes a chemical delay chain which burns for a fixed time. Upon reaching the end of this chemical substance, the primary to the actual explosive is triggered initiating the main explosion. In FIG. 1-B, trigger 10 and arming switch 12 serve the same function as do the battery and capacitor previously discussed. The difference is that as capacitor 16 discharges it must pass through the electronic delay circuit 20 before reaching detonator 22. While the circuit delay 20 is functioning, the impact usually has occured causing arming switch 12 to frequently lose circuit integrity.

Figure 2:
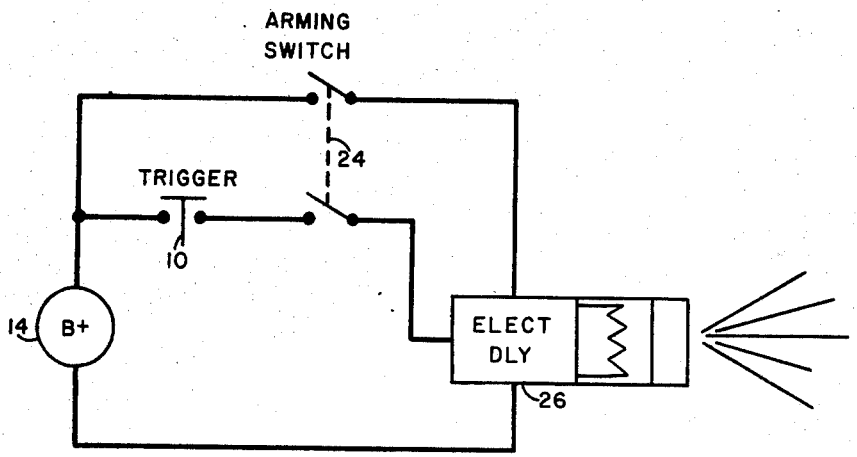
FIG. 2 is a circuit diagram of the present invention.

FIG. 2 is a circuit diagram showing the present invention. As shown, arming switch 24 permits battery 14 to provide power into the electronic delay circuit 26 when the explosive system is armed. The charge provided is stored to be used for initiating the detonation after trigger 10 is closed. When trigger 10 is closed, a further source of power is applied to the circuit and a current flows through the lower half of the arming switch 24. This current will proceed directly into the electronic delay system avoiding any contact problems that may arise at switch 24 due to destruction on impact while the electronic delay signal is being processed. The additional signal provided by trigger 10 must provide sufficient energy to release the stored energy in electronic delay 26 after the time delay to permit the explosion.

Figure 3:
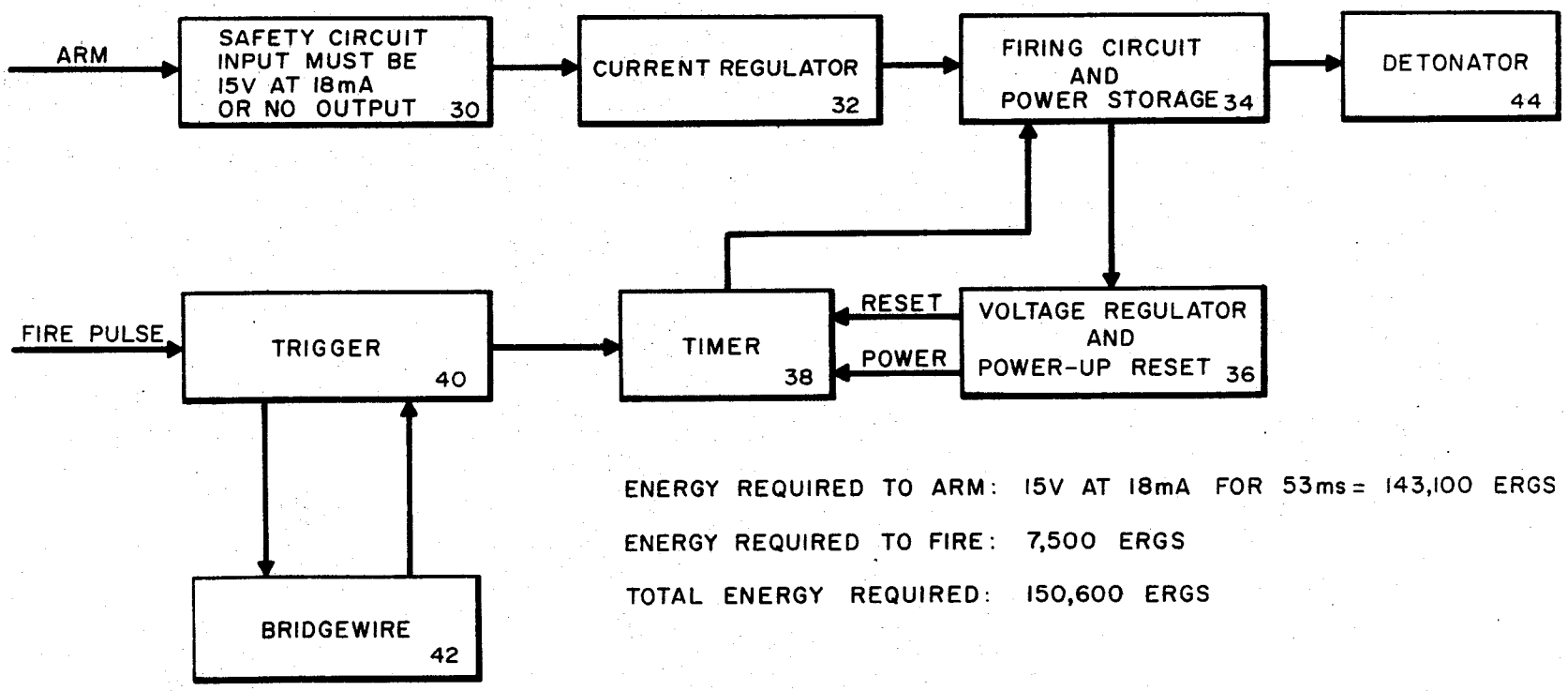
FIG. 3 is a block diagram of the present invention.

FIG. 3 is a block diagram of the present invention. When the circuit is armed through safety circuit 30 the minimum requirement of pre-established current and voltage is provided. The amount specified in safety circuit 30 is an example of a reasonable amount that is not to be construed as a mandatory set of parameters. This current output from safety circuit 30 is further controlled at current regulator 32. This is to provide a safe current into the power storage unit 34 so that overloads which might trigger the detonator are not permitted. Power storage 34 further trips the power up reset circuitry 36 which provides input to timing mechanism 38 to insure that the timer starts from zero upon arming of the circuitry. To provide a triggering pulse to timer 38, the fire pulse initiates the trigger 40. As a further safeguard, trigger 40 is shorted to ground by bridgewire 42. Bridgewire 42 will pass current to ground until it has across its input terminals sufficient voltage to "Blow Open" bridgewire 42 by melting. Once such a sufficnet trigger voltage is present, the timer is actuated and upon its preset delay provides the triggering pulse to the firing circuit 34 which releases the power storage and fires detonator 44. The energy requirements noted in FIG. 3 are given as examples. Significant variations are possible with this type of circuitry depending on the components used.

Figure 4:
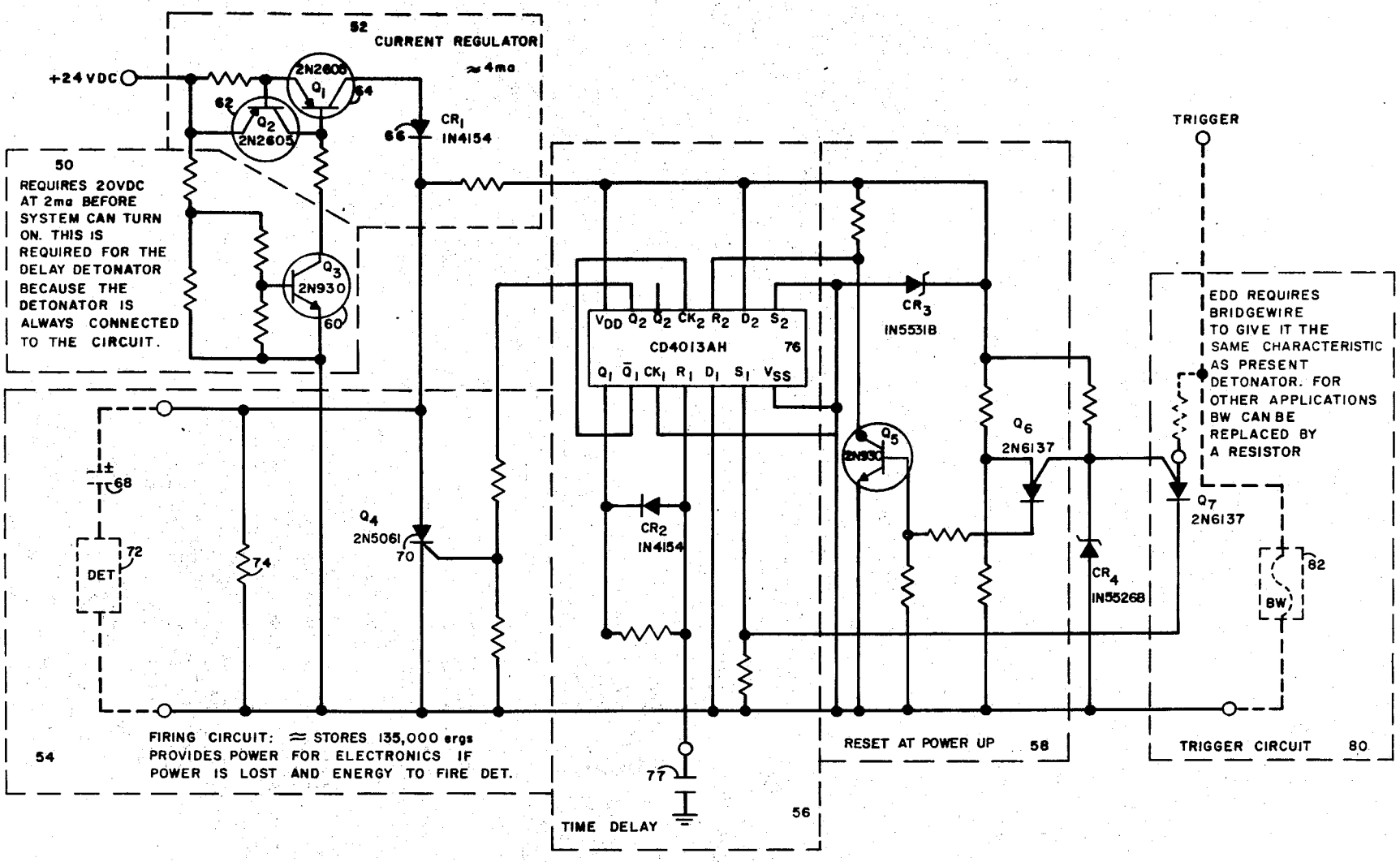
FIG. 4 is a schematic of the complete embodiment of the present invention.

FIG. 4 is a complete schematic of the electronic delay detonator. Block 50 represents the safety circuit. It is noted in block 50 different voltages and current are specified as compared to the safety circuit in FIG. 3. These variations illustrate example ranges which have proven useful in initiating the detonator. The input voltage turns on transistor 60 which, in turn, turns on transistors 62 and 64. These two transistors are a part of the current regulator shown in block 52. The output current for the example shown is held to approximately 4 milliamps. The current from the current regulator 52 passes through diode 66 which serves to block back discharge of current into the current regulator and thus acts to prevent a needless drain of energy. In both blocks 50 and 52 several unlabeled resistors are shown to provide the appropriate circuit balance that is needed. The output from diode 66 serves to charge capacitor 68 which is located in the firing energy storage circuit 54. Typically the detonator 72 has a maximum current ability of 5 milliamps and therefore the current of 4 milliamps is simply chosen as an arbitrary safe level beneath the maximum current capability of detonator 72 which of course can be varied as desired. Silicon controlled rectifier 70 acts as a gate which is turned off to prevent the circuit from being completed between the capacitor and the firing detonator 72. The resistor shown at 74 is a bleed resistor to provide handling safety. It assures no potential is on capacitor 68 prior to arming. Diode 66 provides a further signal to time delay circuit 56 and power up reset circuitry 58. The signal goes into the D flip-flop shown generally by number 76 and provides power. The initial setting signal is provided by the power up reset circuitry 58. The effect of these inputs is to insure that the D flip-flop signals are indeed at the zero settings when the initial signal comes in so as to provide the appropriate delay time. Through the appropriate resistors and diodes, trigger circuit 80 is prepared to receive a trigger signal. When the trigger input signal arrives it will at first attempt to travel to ground through bridgewire 82.

Bridgewire 82 is set to a predetermined level to short or blow out at a minimum desired energy level for the trigger signal. Upon breaking the circuit the triggering device now sees a voltage which sends a signal back through the circuitry shown into the time delay circuit 56. The time period is adjusted by changing the value of an external capacitor 77. Upon passing through time delay circuitry 56, the triggering pulse turns on the silicon controlled rectifier 70 permitting capacitor 68 to discharge through detonator 72 initiating the firing explosives.

Figure 5:
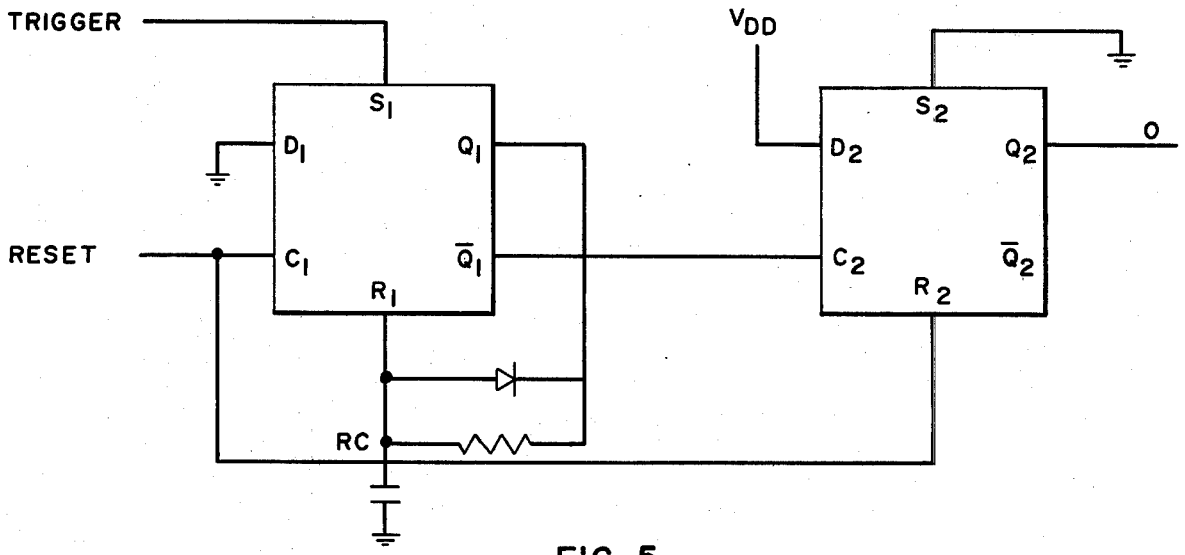
FIG. 5 is a schematic of the time delay circuit.
Figure 6:
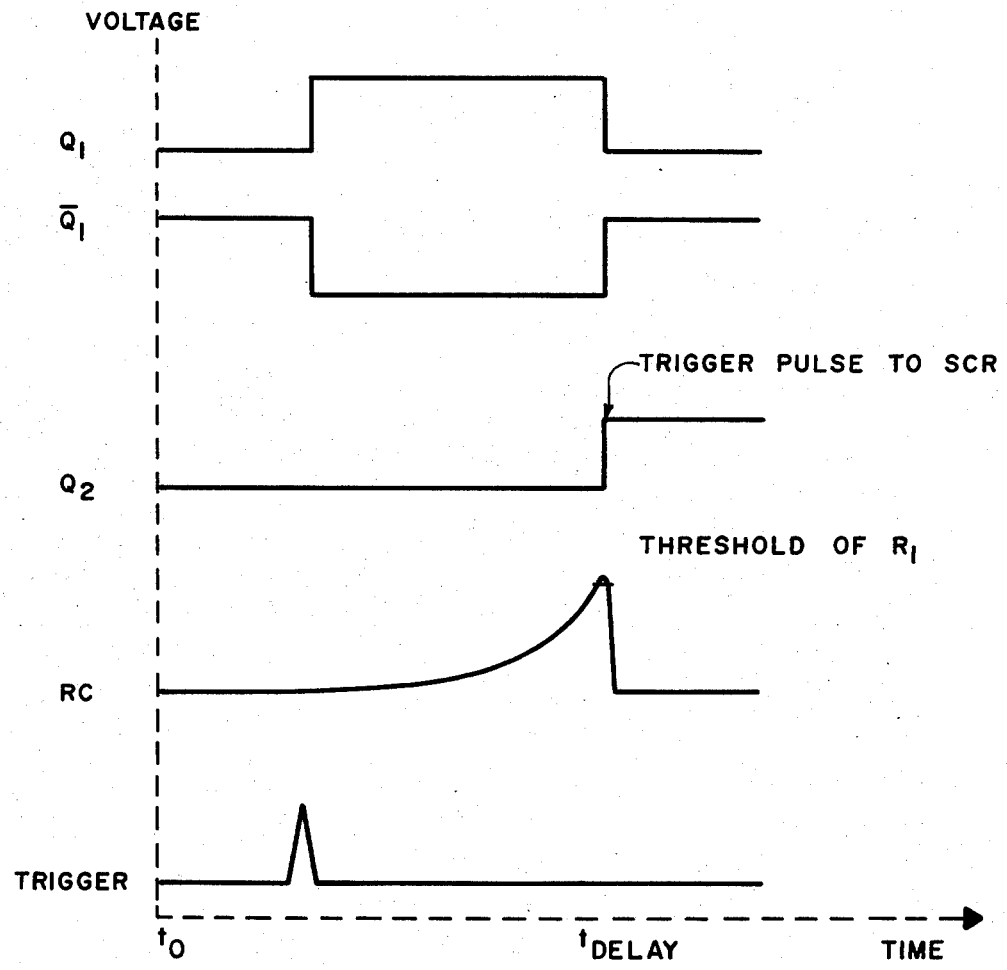
FIG. 6 is a graph of the time delay sequence in the time delay circuit.

Fig. 5. shows the time delay circuitry 56 in greater detail. In the examplary circuit shown, the time delay used is a well known 4013 dual CMOS D flip-flop which is in the configuration of a Monostable Multivibrator. The code letters of flip-flop 76 are expanded to show their functioning in FIG. 5. Input $C_1$ is set by the power up reset input which also goes to point $R_2$ to establish the $Q_2$ output. The outputs from these points can be better understood by refering them to FIG. 6 which is a chart of voltage verses time for each of these points discussed. The reset signal sets $Q_1$ to a low voltage level as it also does to $Q_2$. The $Q_1$ output is initially at a high voltage level since it will always be at a reverse state from $Q_1$. The RC point shown first must start out at a low voltage level. When the triggering pulse is received, it has the effect of reversing the voltage status of $Q_1$ and $Q_1$. When the voltage level output of $Q_1$ switches back to its original high voltage level at-entrance point $C_2$, the voltage output of $Q_2$ is reversed and trigger pulse output from $Q_2$ is sent to the silicon controlled rectifier. The delay time can be varied by changing the RC constant of the circuit shown. This is done by the appropriate variation of the resistance and capacitor shown in FIG. 5.

As can be seen from the circuit shown, many variations and time delay are possible through minor variations of the circuitry. The appropriate circuit components can be varied for the circuit parameters desired, namely minimum current and minimum voltage input. Referring to FIG. 4, all the circuitry shown can remain constant with only capacitor 68 having to be varied depending on the type of detonator 72 desired.

What is claimed is:

1. An electronic delay detonator fired by a trigger signal comprising:

a safety circuit with output current for arming the detonator;

a current regulator electrically connected to said safety circuit output for limiting the current from the safety circuit output so as to produce a current output from said current regulator which cannot cause overloads;

a power storage circuit which inputs said current regulator output for holding in reserve the energy delivered by said regulated current;

a power-up reset circuit which receives as input the output of the current regulator for providing an initial timing signal;

a trigger circuit connected to the power-up reset circuit and has said trigger signal as an input so as to initiate a predetermined fire delay timing period by an output from said trigger circuit;

a fuse placed so as to ground the trigger circuit until a predetermined minimum trigger signal is received;

a time delay circuit which receives the trigger circuit output for causing said fire delay timing period and outputting a signal when said predetermined delay time has passed;

a firing circuit which is activated by the output of the time delay circuit and connected to said power storage circuit for releasing said energy reserve in said power storage circuit; and a detonator which receives said released energy for firing said detonator.

2. An electronic delay detonator as described in claim 1 where the safety circuit contains a diode to prevent reverse current flow.

3. An electronic delay detonator as described in claim 1 where the fuse is a bridgewire.

4. An electronic delay detonator as described in claim 1 where the time delay circuit is a 4013 dual CMOS D flip-flop.

5. An electronic delay detonator as described in claim 1 where the power storage circuit becomes the firing circuit upon the closing of a silicon controlled rectifier by the output of the time delay circuit.

6. An electronic delay detonator as described in claim 2 where the time delay circuit is a 4013 dual CMOS D flip-flop.

7. An electronic delay detonator as described in claim 3 where the time delay circuit is a 4013 dual CMOS D flip-flop.

8. An electronic delay detonator as described in claim 2 where the power storage circuit becomes the firing circuit upon the closing of a silicon controlled rectifier by the output of the time delay circuit.

9. An electronic delay detonator as described in claim 3 where the power storage circuit becomes the firing circuit upon the closing of a silicon controlled rectifier by the output of the time delay circuit.

10. An electronic delay detonator as described in claim 4 where the power storage circuit becomes the firing circuit upon the closing of a silicon controlled rectifier by the output of the time delay circuit.

11. An electronic delay detonator fired by a trigger signal comprising:

a safety circuit with output current for arming said detonator wherein said safety circuit contains a diode to prevent reverse current flow;

a current regulator electrically connected to said safety circuit output for limiting the current from the safety circuit output so as to produce a current output from said current regulator which cannot cause overloads;

a power storage circuit which inputs said current regulator output for holding in reserve the energy delivered by said regulated current;

a power-up reset circuit which receives as input the output of the current regulator for providing an initial timing signal;

a trigger circuit connected to the power-up reset circuit and has said trigger signal as an input so as to initiate a predetermined fire delay timing period by an output from said trigger current;

a bridgewire fuse placed so as to ground said trigger circuit until a predetermined minimum trigger signal is received;

a 4013 dual CMOS D flip-flop time delay cirucit which receives said trigger circuit output for causing said fire delay timing period and outputting a signal when said predetermined delay time has passed;

a firing circuit which is activated by the output of the time delay circuit and connected to said power storage circuit for releasing said energy reserve in said power storage circuit; and a detonator which receives said released energy for firing said detonator.

12. An electronic delay detonator as described in claim 11 where the power storage circuit becomes the firing circuit upon the closing of a silicon controlled rectifier by the output of the time delay circuit.

* * * * *